United States Patent [19]

Shepherd et al.

[11] 4,377,083

[45] Mar. 22, 1983

[54] TUBE CORRUGATING APPARATUS AND METHOD

[76] Inventors: Dale H. Shepherd, 620 Hewitt Rd., Hewitt, Tex. 76643; Lothar R. Zifferer, P.O. Box 8799, Waco, Tex. 76710

[21] Appl. No.: 76,736

[22] Filed: Sep. 18, 1979

[51] Int. Cl.[3] ..... B21D 15/04

[52] U.S. Cl. ..... 72/68; 72/77; 72/367

[58] Field of Search ..... 72/68, 77, 278, 283, 72/367, 67, 276, 274, 121; 113/116 UT; 29/157.3 R

[56] References Cited

U.S. PATENT DOCUMENTS

| | | | |
|---|---|---|---|
| 374,599 | 12/1887 | Henry | 10/94 |
| 496,601 | 5/1893 | Edge | 72/68 |
| 946,641 | 1/1910 | Ballou . | |
| 1,520,871 | 12/1924 | Koontz | 10/100 |
| 1,554,739 | 9/1925 | Lewis | 72/77 |
| 1,919,254 | 7/1933 | Picece et al. | 72/77 |
| 2,452,125 | 10/1948 | Ingalls et al. | 72/367 |
| 2,496,790 | 2/1950 | Guarnaschelli | 72/112 |
| 2,928,528 | 3/1960 | Kelday et al. . | |
| 3,085,529 | 4/1963 | Admerand | 72/77 |
| 3,578,075 | 5/1971 | Winter | 165/177 |
| 3,713,323 | 1/1973 | Ivanier . | |
| 3,998,082 | 12/1976 | Mueller | 72/77 |
| 4,085,607 | 4/1978 | Muller | 72/77 |
| 4,215,559 | 8/1980 | Kuypers | 72/77 |

FOREIGN PATENT DOCUMENTS

| | | | |
|---|---|---|---|
| 218154 | 9/1957 | Australia | 72/68 |

*Primary Examiner*—Lowell A. Larson
*Attorney, Agent, or Firm*—Neal J. Mosely

[57] ABSTRACT

A novel corrugating die for metal tubing is disclosed comprising a hollow die body having one or more die teeth positioned in the internal cavity thereof. The individual die teeth have a flat shape with a curved surface and extend diagonally into the die cavity providing a die corrugating tooth surface extending from the surface of the die cavity inward along a curved line. Preferred embodiments of the die utilize a plurality of die teeth spaced uniformly around the die cavity. The angular positioning of the die teeth is such that the teeth lie somewhat on a helical line.

When a thin-walled, hollow tubing is inserted into the die at the end adjacent to the roots of the die teeth and held against rotation and the die body rotated relative to the tubing, the die teeth corrugate the tubing in somewhat the manner of a thread cutting die. When only one or two die teeth are used, the die teeth must be set at a very low helical pitch. As the number of die teeth is increased the helical pitch may be greater. Rotation of the die body causes the die teeth to corrugate the tubing to a substantial depth defined by the die teeth and shorten the tubing according to the depth and the width of the teeth.

Tubing corrugated by this or other apparatus may be further reduced in size by passing through a stationary reducing draw die. The surface of the tubing is preferably pitted by shot or sandblasting or etching or the like. The product is a novel helically corrugated heat exchange tubing of high heat transfer efficiency.

12 Claims, 22 Drawing Figures

TUBE CORRUGATING APPARATUS AND METHOD

BACKGROUND OF THE INVENTION

1. Field of the Invention

This invention relates to apparatus and methods for forming corrugations in metal heat exchange tubing.

2. Brief Description of the Prior Art

Finned heat exchange tubing is well known in the art for use in radiators, heat exchangers, refrigeration condensors, etc. Many types of apparatus and methods are known for the application of heat exchange fins to heat exchanger tubing.

It is also well known to form heat exchange fins integrally from the wall of heat exchange tubing members. It is also known to corrugate heat exchange tubing into longitudinally extending or circumferentially or helically extending corrugations to provide an increased surface area for heat exchange somewhat equivalent to the the application of external fins to the tubing. The production of helical corrugations and tubing, however, has in the past required the use of an internal mandrel and an external corrugating die cooperable therewith to form the desired corrugations. Such equipment has limited the length of helically corrugated tubing to the length of the mandrel used in the corrugating operation. The has not been a practical method for continuous corrugating of indefinite length of thin walled heat exchange tubing.

Benson U.S. Pat. No. 2,954,121 discloses apparatus for extrusion of metal tubing with helical fins formed intergrally thereon.

Slade U.S. Pat. No. 3,008,187 discloses an extrusion die for extruding thermoplastics having helical corrugations for orienting the plastic material in different directions.

Atkin U.S. Pat. No. 3,267,712 discloses extrusion die for extruding tubing with longitudinally extending fins thereon.

Brothers U.S. Pat. No. 4,159,739 discloses a method and apparatus for forming heat exchange fins integrally from the material of heat exchange tubing.

Ford U.S. Pat. No. 3,850,227 discloses a helically corrugated heat exchange tubing and makes reference in his specification to other types of tubing and to apparatus used for forming such tubing.

Regner U.S. Pat. No. 3,988,804 discloses the use of a rotating die having helical internal fins for forming thin walled tubular cellophane film into a pleated or shirred form having helically formed pleats.

OBJECTS OF THE INVENTION

One object of this invention is to provide a new and improved rotating die for corrugating thin walled heat exchange tubing.

Another object of this invention is to provide a rotating tube corrugating die having one or more die teeth removably positioned therein and set at an angle to form tubular corrugations corresponding to the pitch of the die teeth.

Another object of this invention is to provide an improved tube corrugating apparatus comprising a rotating die having one or more die teeth set at an angle within the die body, said die teeth having a curved inwardly extending surface and varying from the thin sharp edge at the root of the tooth to a wide surface at the innermost extension thereof.

Another object of this invention is to provide a new and improved die corrugating apparatus in which tubing is corrugated by a rotating die and subsequently passed through a stationary reducing draw die to produce helically corrugated tubing of predetermined outside diameter.

Another object of this invention is to provide an improved method for corrugating thin walled tubing by use of a rotating corrugating die of novel construction.

Another object of this invention is to provide an improved method for producing helical corrugations in thin walled tubing by passing the tubing through a rotating die having die teeth of curved shape projecting into the die cavity, which teeth vary from a knife edge thickness at the root thereof to a substantial width at the peak of the tooth.

Another object of this invention is to provide a new and improved method for producing corrugated tubing of predetermined size in which the tubing is first corrugated by use of a rotating die and then passed through a stationary sizing draw die.

Another object of this invention is to provide an improved heat exchange tubing produced in accordance with the method of this invention and optionally provided with a pitted or edged surface for enhancement of heat exchange properties.

Other objects of this invention will become apparent from time to time throughout the specification and claims as hereinafter related.

SUMMARY OF THE INVENTION

This invention comprises a new and improvd method and apparatus for forming helical corrugations in metal tubing. Thin walled metal tubing is held against rotation and passed through a hollow rotating corrugating die. The corrugating die has one or more die teeth positioned in the internal cavity thereof and extending radially inward. The die teeth are flat in shape and have a curved surface extending inwardly. The die teeth extend diagonally relative to the axis of the die cavity and preferably extend at an angle corresponding to the pitch of the helical corrugation to be formed.

When a thin walled hollow tubing is inserted into the die cavity at the end adjacent to the roots of the die teeth, and is held against rotation, and the die body is rotated, the die teeth corrugate the tubing in somewhat the manner of a thread cutting die and further function to feed the tubing through the die. When only one or two die teeth are used they must be set at a very low pitch. As the number of die teeth is increased the pitch may be correspondingly greater. The die teeth are preferably very narrow or sharp at the root of the each tooth and widen as the surface extends toward the peak of the tooth. The depth and width of the teeth determine the depth of the corrugations and the extent of shortening of the tubing in the corrugating operation. Tubing which has been corrugated by this or other apparatus may be further reduced in size by passing through a stationary reducing draw die. The surface of the product tubing is preferably finished by pitting a shot or sandblasting or etching or the like to produce heat exchange tubing of high heat transfer efficiency.

DESCRIPTION OF THE PREFERRED EMBODIMENTS

Figure 1:
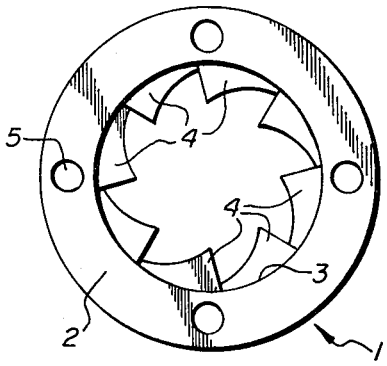
FIG. 1 is an end view of one tube corrugating die representing a preferred embodiment of the invention, said die having eight corrugating teeth.
Figure 2:
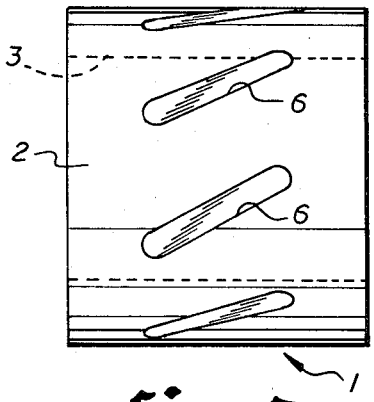
FIG. 2 is a side view of the corrugating die shown in FIG. 1.
Figure 3:
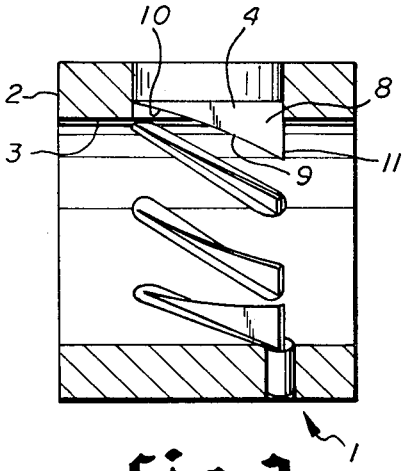
FIG. 3 is a sectional view taken along the line 3—3 of FIG. 1, with the upper portion of the section taken along a flat surface of the corrugating die tooth.

Referring to the drawing by numerals of reference and more particularly to FIGS. 1–7, there is shown a novel tube corrugating die 1 comprising a die body 2 which is cylindrical in shape, but could be of a regular shape such as square, hexagonal, octagonal, etc. Die body 1 has a cylindrical bore 3 there through into which protrude a plurality of die teeth 4. Die body 2 also is provided with a plurality of mounting holes or apertures 5. Die teeth 4 are positioned in flat slots 6 in die body 2 and have the tooth portion extending into the bore 3 as seen in FIG. 3.

Figure 5:
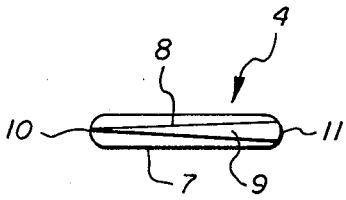
FIG. 5 is a plan view of the die tooth of FIG. 4.
Figure 7:
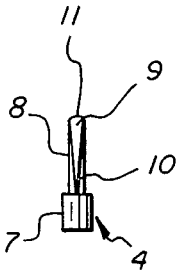
FIG. 7 is a view in right elevation of the die tooth shown in FIG. 4.
Figure 4:
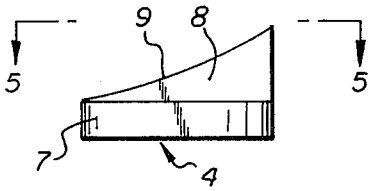
FIG. 4 is a view in elevation of one of the die teeth shown in FIG. 1.
Figure 6:
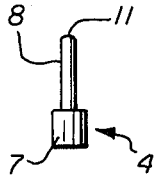
FIG. 6 is a view in left elevation of the die tooth of FIG. 4.

The die teeth 4 are shown in detail in FIGS. 4–7, respectively. Die teeth 4 comprise a supporting base portion 7 which is rectangular in cross section and has parallel sides which fit into slots 6 in die body 2. The tooth portion 8 of die teeth 4 is curved as indicated at 9 in FIG. 4 in the side view of the die tooth structure. The root of the die tooth portion 8 adjacent to the supporting portion 7 is very narrow and constitutes approximately a knife edge as seen at the right of FIG. 5 and at the front of FIG. 7. The curved surface 9 of the die tooth portion 8 increases in width from knife edge 10 to a wide rounded portion 11 at the upper end of the die tooth. The shape of the die teeth is quite important in corrugating and gathering a metal tubing.

The die teeth 4 are positioned in slots 6, as shown in FIG. 2, and lie at a substantial angle to the longitudinal axis of die body 2. As a result, die teeth 4 are positioned with the root portion 10 of very narrow, almost knife edge, construction adjacent to the inner surface of bore 3. The die teeth curve along line 9 inwardly of bore 3 with the inner most projecting portion 11 projected substantially into bore 3. Die teeth 4 are all set at substantially the same angle relative to the longitudinal axis of die body 2 with with the result that the curved surfaces 9 of the die teeth lie approximately on a segment of a helix. The angle of slot 6 is preferably the angle of pitch of a helix which will provide helical indentations in tubing being corrugated which are about the same width as the corrugations being produced.

Figure 17:
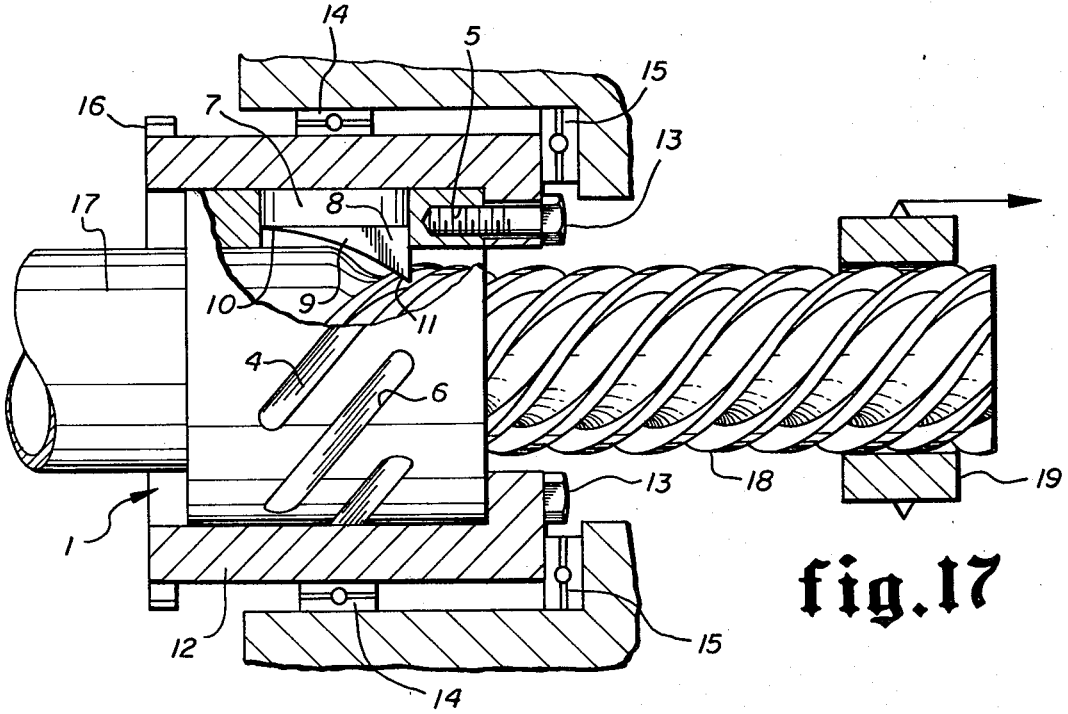
FIG. 17 is a schematic view illustrating the assembly of the rotating die shown in FIG. 1 in a tube corrugating apparatus and illustrating the progress of tubing through the die.
Figure 18:
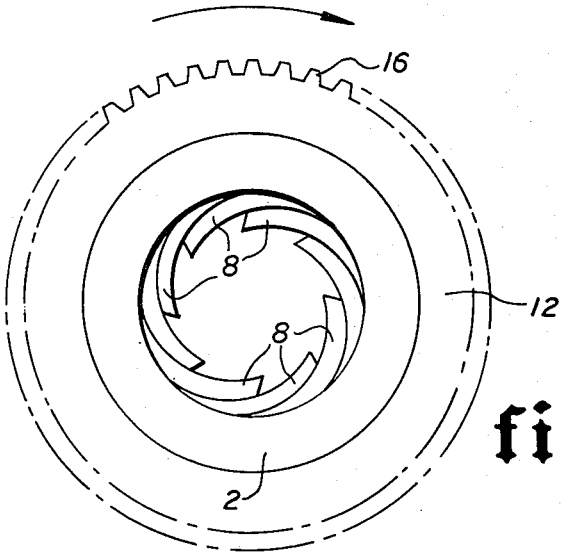
FIG. 18 is a view in left elevation of the rotating die apparatus shown in FIG. 17.

In FIGS. 17 and 18 corrugating die 1 is illustrated in position in apparatus for producing helical corrugations and thin walled tubing. Die body 2 is positioned in hollow supporting block 12 and is held in place by retaining screws or bolts 13 which extend into apertures 5. Supporting body 12 has a cylindrical outer surface and is supported on bearings 14 on the outside and bearings 15 at the end surface. Die supporting body 12 is provided with a sprocket or gear 16 which may be connected to a suitable drive means (not shown) which drives a direct drive gear or a drive chain for the gear or sprocket. The supporting structure shown in FIG. 17 is somewhat schematic and it is to be understood that any suitable die support table could be used. This equipment is preferably used with a conventional draw bench and the schematic supporting structure shown in FIG. 17 refers to the supporting elements of a draw bench and any support members thereon required to support the corrugating die in a horizontal position for rotation, as shown.

A thin walled cylindrical tubing 17 is introduced into the end of die body 2 into the bore 3 adjacent the root portion 10 of die teeth 8. Die body 2 is rotated by action of the drive means (not shown) on sprocket or gear 16 which causes supporting body 12 to rotate. As die body 2 is rotated, die teeth 8 grip tubing 17 and start to indent the tubing along helical lines. Die body 2 is rotated clockwise, as seen in FIG. 18, which causes the root portion 10 of each of die teeth 8 to engage the surface of hollow tubing 17 and progressively said surface along helical lines which are equally spaced. As tube 17 is indented by progressive movement of curved surface 9 of the die teeth 8, a plurality of helical corrugations are formed which correspond in number to the number of die teeth (in this embodiment, 8 die teeth) and said corrugations have a pitch which is determined by the angle of slots 6 in which die teeth 8 are mounted. The corrugations which are produced have a depth which is determined by the height of the peak portion 11 of die teeth 8. The shape of die teeth 8 which varies from nearly a knife edge at the root portion 10 to a fairly wide surface 11 at the peaked portion of the tooth is effective to start the creasing or corrugating of tubing 17 along a relative sharp line which is progressively spread by the progressing width of die teeth 8 which gathers the tubing in a longitudinal direction.

During rotation of die body 2, tubing 17 must be restrained from rotating. The corrugated tubing 18 which emerges from the rotating die body 2 is corrugated with a plurality of helical corrugations which correspond in number to the number of die teeth 8 (in this embodiment, 8 die teeth) and in which the width of the corrugations is about the same as the width of the grooves formed by die teeth 8 in making the corrugations. After the corrugated tubing 18 emerges from the rotating die, it may be secured in clamp 19 which may be the draw block of a draw bench and movable along the surface of the bench (not shown). The clamp or draw block 19 is effective to prevent tubing 17 and corrugated tubing 18 from rotating during the corrugating of the tubing by rotation of die body 2.

Figure 20:
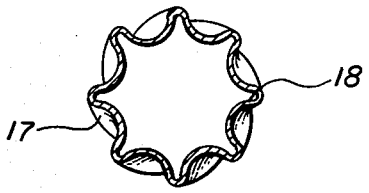
FIG. 20 is an end view of the corrugated portion of the tubing shown in FIG. 19.
Figure 19:
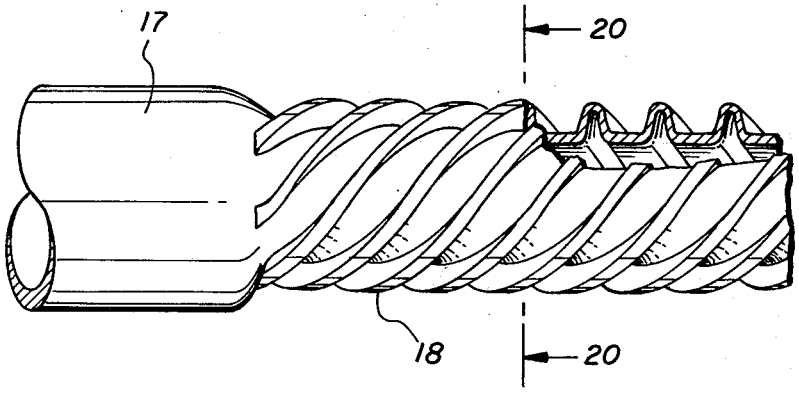
FIG. 19 is a view in elevation, and partly in broken section, of a piece of thin walled tubing which has been partially corrugated using the apparatus and method of this invention.

The rotation of die body 2 may be effected by a positive drive operating on gear or sprocket 16 which rotates supporting body 12. Alternatively, the supporting body 12 may be allowed to rotate freely once the corrugated portion 18 of the tubing 17 has emerged from die body 2 and been fastened to clamp or draw block 19. Clamp or draw block 19 may then pull tubing 17 through die body 2 and the die body will rotate and produce corrugations in the same manner as when it is positively driven. In most cases, however, it is desirable to provide a positive drive to rotate supporting body 12 and die body 2 since the rotation of die teeth 8 functions not only to corrugate tubing 17 but also to positively drive the tubing through the rotating die. When operated in this manner, it is possible to corrugate indefinite lengths of thin walled hollow tubing. For example, it is possible to feed great lengths of hollow tubing directly from a supporting spool and corrugate the tubing continuously. In the embodiment shown in FIGS. 1–7 and in the apparatus shown in FIGS. 17–18, the tubing produced has eight helical corrugations of very substantial pitch. Details of this tubing are shown more clearly in FIG. 19 wherein part of the wall of the corrugated tubing portion 18 is broken away to show the corrugations. Also, in FIG. 20, an end view of the corrugated tubing is shown.

Figure 22:
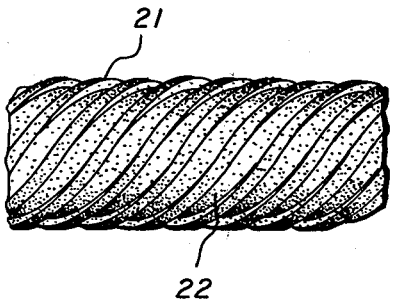
FIG. 22 is a view in elevation of corrugated tubing after passing through the reducing die of FIG. 21 and further subjected to sandblasting or shot blasting or etching to produce a pitted surface.

In corrugating tubing using this apparatus and method, there is some slight variation in size of the corrugations. It is desired to produce a corrugated tubing of very uniform size and shape. Accordingly, the corrugated tubing 18 is perferably passed through a stationary draw die 20 where it is further reduced in size by being therethrough. The corrugated tubing emerging from draw die 20 is indicated at 21 to have a smaller but uniform diameter. The rate of pulling the corrugated tubing through draw die 20 is usually different from the rate that the tubing is passed through the rotating corrugating die and so the draw die should be at a different location. Of course, in apparatus where the corrugating die and the stationary draw die can be operated at the same speed the dies can be located in-line for continuous operation. Since the corrugating tubing is designed for use in heat exchange capacity by sandblasting or shot blasting or etching to produce a roughened surface 22 as shown in FIG. 22. The product thus obtained has a roughened surface and corrugations of selected size and shape and has a greatly enhanced heat exchange capacity. This corrugated tubing is particularly useful in refrigeration and air-conditioning equipment, and may also be used in industrial heat exchangers, radiators and the like.

Corrugating die 1 is quite versatile in design. The die teeth 4 may be varied in shape and the extent of protrusion of the individual die tooth portion 8 may be varied to produce a desired depth of corrugation in the tubing being corrugated. Likewise, the width of the upper portion 11 of die tooth portion 8 may be varied in size to vary the amount of gather of the tubing informing the corrugations. The angle of slots 6 in die body 2 may likewise be varied to set the pitch of the helical corrugations at any desired value. The number of die teeth 4 used in corrugating die 1 may be varied in number according to the number of corrugations desired. Any desired number of die teeth may be used from a single die tooth up to a very substantial number. FIGS. 8–13 of the drawings illustrate other embodiments of the corrugating die which illustrate this point.

ALTERNATE EMBODIMENTS

Figure 8:
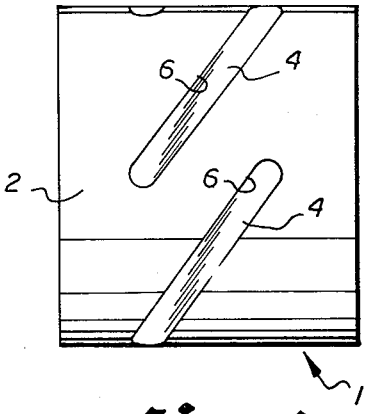
FIG. 8 is a side view of another embodiment of corrugating die having four corrugating teeth.
Figure 9:
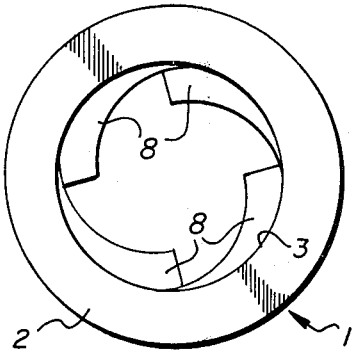
FIG. 9 is an end view, similar to FIG. 1, of the die shown in FIG. 8.

In FIGS. 8 and 9 there is shown an alternate form of corrugating die 1 having die body 2 as in the preferred embodiment. In FIGS. 8 and 9, die body 2 has only four equally spaced slots 6 around the surface of the die body 2 in which die teeth 4 are positioned with the die tooth portions 8 thereof extending into internal bore 3. In this embodiment, the angle of slots 6 relative to the longitudinal axis of die body 2 is substantially greater than in FIG. 2 to insure that the width of the corrugations and of the grooves between the corrugations will be substantially the same.

Figure 10:
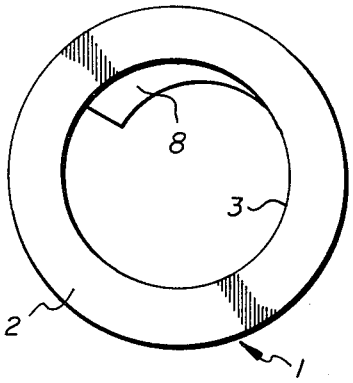
FIG. 10 is an end view, similar to FIG. 1, of a rotating die having a single die tooth.

In FIG. 10, corrugating die 1 is provided with only a single die tooth for having a single die tooth portion 8 extending into bore 3. When a single die tooth is used, the slot 6 in which it is supported will be almost at right angles to the longitudinal axis, will be just sufficient to permit the die tooth portion 8 to advance along a single helical line in corrugating the tubing 17. This very high angle of the die tooth relative to the longitudinal axis is necesary so that when a single helical corrugation is formed the width of the groove will be approximately equal to the width of the corrugation. It should be noted that when a single tooth is used and the angle of the tooth is almost at right angles to the longitudinal axis of the die body 2, the die must be positively rotated. The tubing cannot be pulled through this die because of the angle of positioning of the die tooth 8. The rotation of the die body, however, will be effective to corrugate tubing 17 in a single helical corrugation.

Figure 11:
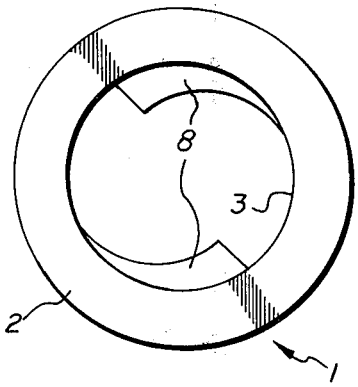
FIG. 11 is an end view, similar to FIG. 1, of a rotating die having two die teeth.

In FIG. 11, corrugating die 1 has two die teeth will die teeth portions 8 extending into bore 3 of die body 2. The angle of positioning of the die teeth in the slots 6 is such that the die teeth will form double helical corrugations with the width of the corrugations being about the same as the width of the grooves between the corrugations. This embodiment likewise requires that the die body be positively rotated.

Figure 12:
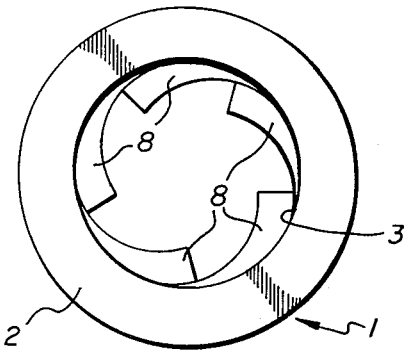
FIG. 12 is an end view, similar to FIG. 1, of a rotating die having five die teeth.

In FIG. 12, an embodiment is shown of corrugating die 1 consisting of die body 2 having five die teeth portions 8 extending into bore 3. This corrugating die will produce five helical corrugations when positively rotated or when tubing 17 is drawn through the die which is allowed to rotate freely.

Figure 13:
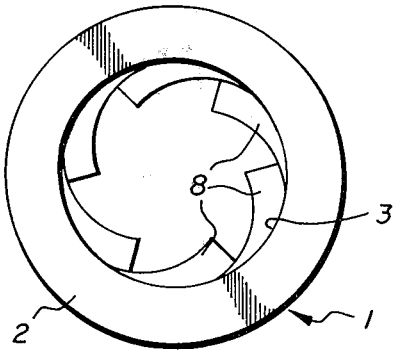
FIG. 13 is an end view, similar to FIG. 1, of a rotating die having six die teeth.

In FIG. 13, a still further embodiment is shown of corrugating die 1 in which die body 2 has six die teeth portions 8 positioned in bore 3. Rotation of this die will produce six helical corrugations in tubing 17. The pitch of the individual helixes is determined by the angle of the individual die teeth relative to the axis of the rotating die body. The angle positioning of the die teeth also determines to some extent the relative spacing of the corrugations.

ANOTHER EMBODIMENT

Figure 14:
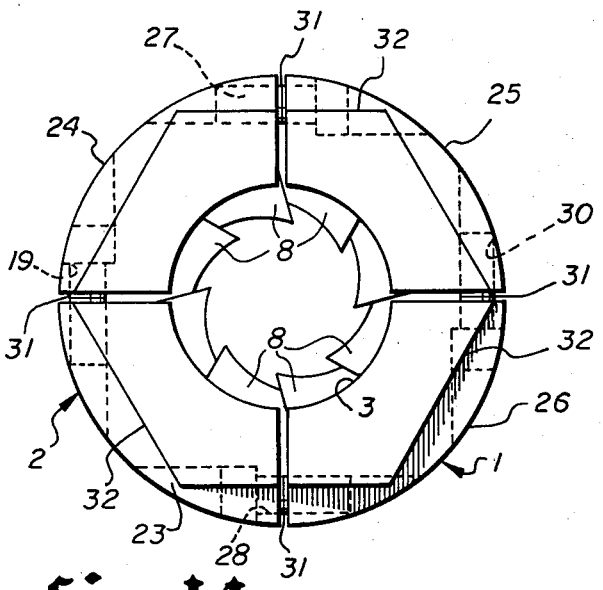
FIG. 14 is an end view of a rotating die, similar to FIG. 1, in which the die body is formed of four separate segments.
Figure 15:
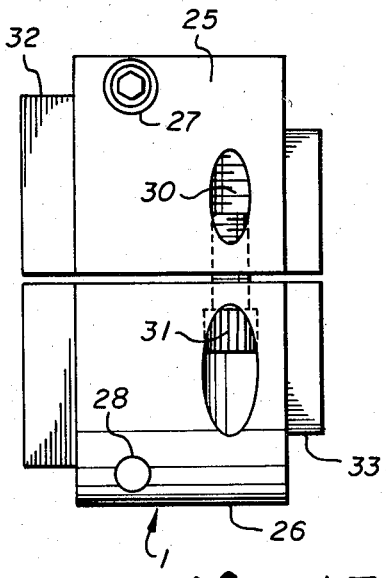
FIG. 15 is a side view of the die shown in FIG. 14.
Figure 16:
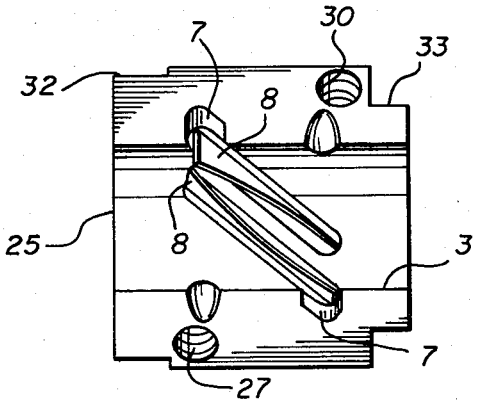
FIG. 16 is a plan view of one of the die body segments of the embodiment shown in FIG. 14, showing the location of the die teeth therein.

In the embodiments previously described, die body 2 has been of a unitary construction and die teeth 4 have been inserted into die body 2 through slots 6 extending form the outer surface of die body 2 into inner bore 3 thereof. In FIGS. 14–16, there is shown a further embodiment of the invention in which die body 2 is segmented and the die teeth are inserted into slots adjacent to the bore when the segments are disassembled.

In FIG. 14, corrugating die 1 is shown to have a die body 2 having internal bore 3 with die teeth portions 8 extending into said bore. Die body 2 is formed of four body segments 23, 24, 25, and 16. These segments have apertures or passages 27, 28, 29 and 30. Screws or bolts 31 are positioned in the respective apertures or passages 27–30 to secure the die body segments together as shown in FIG. 14 and 15. Die body 2 has a plurality of flats 32 cut in the surface thereof to define a hexagonal shape in the portion. At the other end of die body 2 there is provided a cylindrical extensions 33 of reduced diameter.

In FIG. 16, there is shown a detailed view of one of the die body segments 25 showing angularly extended slots 34 in which die teeth 4 are positioned.

In this embodiment of the invention, the corrugating die 1, when assembled, does not require an external supporting block 12 to secure the die teeth against radial displacement during operation. In this embodiment, the die teeth are supported rigidly in slots 34 and cannot move radially outward. This segmented die, when assembled, may be used directly in courrugating the thin walled tubing 17 without the need for a supporting die body.

Figure 21:
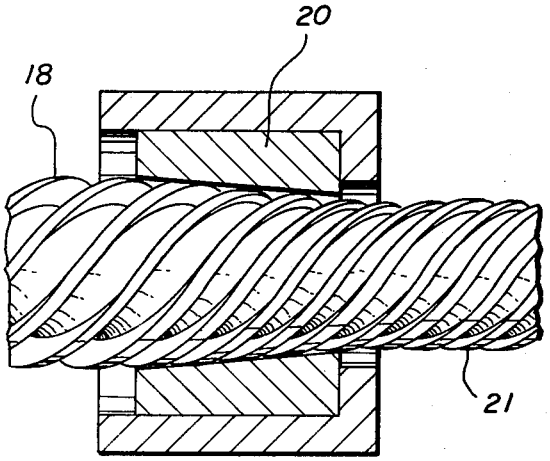
FIG. 21 is a view partially in section and partially in elevation showing a stationary reducing draw die for reducing the size of the helically corrugated tubing of FIG. 19 or FIG. 17 to a predetermined smaller uniformed size.

In the several embodiments of this invention, it is seen that the novel corrugating die 1 may be of a unitary die body construction or may be formed of segments which are assembled, as in FIGS. 14–16. Any desired number of die teeth 4 may be used according to the number of helical corrugations desired. When a small number of die teeth are used, e.g. one, two three, the angle at which the die teeth must be set in die body 2 to produce equally spaced corrugations is such that the die body msut be positively rotated. When a greater number of die teeth are used, the angle at which the die teeth are set in the the die body is such that the die body may be positively rotated, if desired or may be allowed to rotate freely and the tubing pulled through the die by use of the clamp or draw block 19. Of course, the die body would have to be positively rotated to initiate the formation of the corrugated tubing portion 18 to which the clamp or draw block would be attached. The number of corrugations may be varied according to the number of die teeth used. The pitch of the helical corrugations may be varied according to the angle at which the die teeth are set. The depth and width of the corrugations are determined partially by the angle of setting of the die teeth and partially by the width of the die teeth, and particularly the variation in width from the root portion 10 to the protruding portion 11. The depth of the corrugation is largely determined by the extent of protrusion of the protruding portion 11 of the die teeth. The product of any of the corrugating dies is a tubing having one or more corrugations which provides a greatly increased surface area for heat exchange purposes. The tubing may be further sized by passing through a stationary reducing draw die 20 as shown in FIG. 21 and may be roughened or pitted as described in connection with FIG. 22.

While this invention has been fully and completely described with special emphasis upon several preferred embodiments, it should be understood that within the scope of the appended claims the invention may be practiced otherwise than as specifically described herein.

We claim:

1. A metal tube corrugating die operable to corrugate tubing without a supporting mandrel comprising a hollow die body having a longitudinally extending bore therethrough, a plurality of die teeth supported in said die body equidistantly around the circumference of and extending into said bore, each of said die teeth having a straight supporting base portion supported in said die body at an angle to the longitudinal axis thereof, and a corrugating die portion comprising a flat planar plate extending from said base portion radially inward of said bore and having an edge curving inward from a root portion adjacent to the surface of said bore to a peak portion radially inward therefrom and having an arcuate length of a small fraction of one helical coil of the tubing corrugated therein, the angle and spacing of said die teeth being such that multiple uniform helical corrugations in thin walled tubing are produced by passing such tubing therethrough while rotating said die.

2. A metal tube corrugating die according to claim 1 in which each of said die teeth has said curved surface of varying width from a narrow relatively sharp edge at said root portion widening gradually to a wide portion at the peak portion thereof.

3. A metal tube corrugating die according to claim 1 in which said die body includes a plurality of radially extending each of which is rectangular in cross section, opening into said bore to support the base portion of a die tooth therein with said plate portion extending into said bore.

4. A metal tube corrugating die according to claim 1 in which said die body comprises a plurality of segments releasably secured together, and each of said die body segments having a slot extending along the surface of said bore at an angle to the longitidunal axis thereof to support said die tooth base portion with said corrugating die portion extending into said bore.

5. A metal tube corrugating apparatus operable to corrugate tubing without a supporting mandrel comprising a supporting base member, a hollow tube corrugating die, means supporting said tube corrugation die on said base member for rotation about a horizontal axis, means for rotating said corrugating die, said corrugating die comprising a hollow die body having a longitudinally extending bore therethrough, a plurality of die teeth supported in said die body equidistantly around the circumference of and extending into said bore, each of said die teeth having a straight supporting base portion supported in said die body at an angle to the longitudinal axis thereof, a corrugating die portion comprising a flat planar plate extending from said base portion radially inward of said bore and having an edge curving inward from a root portion adjacent to the surface of said bore to a peak portion radially inward therefrom and having an arcuate length of a small fraction of one helical coil of the tubing corrugated therein, the angle and spacing of said die teeth being such that multiple uniform helical corrugations in thin walled tubing are produced by passing such tubing therethrough while rotating said die, and said base member including means to draw a tubing through said die and to secure the leading end of said tubing against rotation while being corrugated by passing through said corrugating die.

6. A metal tube corrugating apparatus according to claim 5 in which said tubing securing means comprises a draw clamp movable along the surface of said supporting base member.

7. A metal tube corrugating apparatus according to claim 5 including a stationary draw die positioned on said supporting base member for sizing unreinforced corrugated tubing produced by said tube corrugating die.

8. A metal tube corrugating apparatus according to claim 5 in which said die tooth has said curved surface of varying width from a narrow relatively sharp edge at the root portion thereof widening gradually to a wide portion at the peak portion thereof.

9. A metal tube corrugating apparatus according to claim 7 in which said draw die is aligned with said corrugating die.

10. A method of formng helical corrugations in thin wall metal tubing comprising holding the leading end of said tubing against rotation and drawing the same longitudinally through a rotating corrugating die as defined in claim 1 or 5.

11. A method of forming helical corrugations in thin wall metal tubing comprising holding said tubing against rotation and passing the same longitudinally into a corrugating die as defined in claim 1, and positively rotating said die.

12. A method of forming helical corrugations in thin wall metal tubing in accordance with claim 11 in which said corrugated tubing is subsequently passed through a stationary draw die to further reduce the outer diameter of said corrugations to a predetermined size.

* * * * *